US006131885A

United States Patent [19]

Berg et al.

[11] Patent Number: 6,131,885

[45] **Date of Patent: *Oct. 17, 2000**

[54] PLASTIC, T-SHAPED FENCE POST

[75] Inventors: Jon A. Berg; Ronald H. Langlie; David F. Buelow, all of Ellendale, Minn.

[73] Assignee: North Central Plastics, Inc., Ellendale, Minn.

[ * ] Notice: This patent is subject to a terminal disclaimer.

[21] Appl. No.: 08/909,286

[22] Filed: Aug. 11, 1997

[51] Int. Cl.[7] ..... E04H 17/10

[52] U.S. Cl. ..... 256/19; 256/10; 256/54; 174/158 F

[58] Field of Search ..... 256/10, 32, 47, 256/48, 50, 51, 84, 19, DIG. 3, 13.1; 174/163 F, 161 F, 158 F; 404/6, 9, 10

[56] References Cited

U.S. PATENT DOCUMENTS

| | | | |
|---|---|---|---|
| D. 204,763 | 5/1966 | Fulbright . | |
| 229,385 | 6/1880 | Cunningham . | |
| D. 243,614 | 3/1977 | Russo . | |
| 294,493 | 3/1884 | Miner . | |
| 390,951 | 10/1888 | Dow . | |
| 1,041,848 | 10/1912 | Myers | 256/10 X |
| 1,517,119 | 11/1924 | Luhring . | |
| 2,123,329 | 7/1938 | Combs et al. | 403/383 X |
| 2,821,365 | 1/1958 | Lach . | |
| 2,861,122 | 11/1958 | Flower . | |
| 3,081,848 | 3/1963 | Nordeng | 256/13.1 X |
| 3,091,997 | 6/1963 | Bryd | 404/10 |
| 3,385,565 | 5/1968 | Cuthbert | 256/13.1 |
| 3,464,671 | 9/1969 | Thomas . | |
| 3,579,908 | 5/1971 | Morgan | 256/48 X |
| 3,654,383 | 4/1972 | Wilson . | |
| 3,788,336 | 1/1974 | Steffes . | |
| 3,977,653 | 8/1976 | Fingerson et al. . | |
| 4,032,248 | 6/1977 | Parduhn et al. | 404/10 |
| 4,046,356 | 9/1977 | Rose . | |
| 4,070,007 | 1/1978 | Minor et al. . | |
| 4,099,585 | 7/1978 | Emmerich | 403/378 X |
| 4,105,350 | 8/1978 | O'Donnell . | |
| 4,185,424 | 1/1980 | Streit . | |
| 4,290,712 | 9/1981 | Hayes | 404/10 |
| 4,357,001 | 11/1982 | Schmanski et al. | 256/50 X |
| 4,358,090 | 11/1982 | Glaesener | 256/13.1 |
| 4,470,579 | 9/1984 | Aho | 256/10 |
| 4,779,955 | 10/1988 | Schmanski | 404/9 X |
| 4,787,601 | 11/1988 | Rybak | 256/19 |
| 5,032,693 | 7/1991 | Langlie et al. | 174/158 F |
| 5,063,274 | 11/1991 | Johnson | 174/158 F |
| 5,085,409 | 2/1992 | Teixeira | 256/48 |
| 5,205,236 | 4/1993 | Hughes | 404/10 X |
| 5,255,897 | 10/1993 | Pepper | 256/24 |
| 5,395,093 | 3/1995 | Chrisman . | |
| 5,452,965 | 9/1995 | Hughes, Sr. | 404/10 |
| 5,577,710 | 11/1996 | Kirby . | |
| 5,975,501 | 11/1999 | Berg et al. | 256/48 |

FOREIGN PATENT DOCUMENTS

| | | | |
|---|---|---|---|
| 2455854 | 12/1980 | France | 256/10 |
| 1343486 | 10/1987 | U.S.S.R. | 256/10 |

OTHER PUBLICATIONS

Information Sheet entitled POSTS, Polycarb QuikPost III, 1997 Premier Sheep Supplies, Ltd.

*Primary Examiner*—Harry C. Kim
*Attorney, Agent, or Firm*—Merchant & Gould P.C.

[57] ABSTRACT

A plastic fence post for use in electric fences, which can be quickly and easily adjusted in height to permit changes in the height of the fence, and which can be used with different types of fence strands. The fence post includes an elongated, T-shaped plastic lower post member having one end adapted for insertion into the ground and an opposite end having a T-shaped slot formed therein. A plastic upper member, which can either be an upper fence post or a post cap, includes a T-shaped tongue extending therefrom that is secured within the T-shaped slot so as to secure the upper member to the lower post member. A pin extends through aligned holes in the end of the lower post member and the T-shaped tongue in order to fasten the upper and lower members together. The height of the fence can be increased by disposing the tongue of the upper fence post within the T-shaped slot, and using the pin to secure the posts together. When the height of the fence post assembly is not to be increased, the fence post cap is disposed within the T-shaped slot and secured by the pin. In each embodiment, the T-shaped slot, T-shaped tongue, and pin provide a fast and easy way to permit adjustments to the height of the fence.

30 Claims, 6 Drawing Sheets

PLASTIC, T-SHAPED FENCE POST

FIELD OF THE INVENTION

The present invention relates to fence posts, in particular a plastic fence post for use in electric fencing systems.

BACKGROUND OF THE INVENTION

Non-metallic fence posts for use in electric fencing systems are generally known from U.S. Pat. Nos. 4,046,356, 4,070,007, 3,977,653, 3,464,671, 2,861,122, and 2,821,365. These conventional fence posts suffer from a major disadvantage because no provision is made for adjusting the height of the fence posts so as to permit adjustment in the height of fence. Being able to adjust the height of a new or existing fence is a desirable feature as it allows the fence to be altered to the changing needs of a user.

Further, any height adjustable fence post should be easy to assemble and use, permitting fast and easy alterations in the fence height. U.S. Pat. No. 5,395,093 to Chrisman provides an extender for use in extending the height of metallic fence posts. However, the use of the Chrisman extender involves a complicated deformation procedure of the extender before it can be used. In addition, further securement of the extender to the fence posts is generally required after the posts are inserted into the extender. Further, being metallic, the fence posts and extender of Chrisman are relatively heavy and prone to rusting. To change the height of an existing post, the extender of Chrisman must be first installed over the end of the post before another post can be added thereto.

Additionally, fence posts generally utilize systems for securing fencing members or strands, e.g. electric wire or tape, barbed wire, etc., thereto at spaced locations along the posts. These previous systems for securing however are generally designed with a single type of fencing member in mind and do not allow for a wide range of fencing materials to be secured to the posts.

What is needed then is a non-metallic fence post for use in constructing a fence, where the height of the fence post can be quickly and easily adjusted, and which can be used with a wide variety of fencing materials.

SUMMARY OF THE INVENTION

Therefore the general purpose of the present invention is to provide a non-metallic fence post, for use in electric fences, which can be quickly and easily adjusted in height to permit changes in the height of the fence, and which can be used with different types of fencing materials.

A preferred embodiment of a fence post assembly in accordance with the principles of the present invention includes an elongated, T-shaped plastic lower post member having one end adapted for insertion into the ground and an opposite end having a T-shaped slot formed therein. A plastic upper member includes a tongue extending therefrom which is secured within the T-shaped slot so as to secure the upper member to the lower post member. Preferably the tongue is T-shaped, and a pin extends through aligned holes in the end of the lower post member and the T-shaped tongue in order to fasten the upper and lower members together.

In one preferred embodiment, the upper member is a fence post that is secured to the lower post member. Therefore the height of the fence can be increased by disposing the tongue of the upper post within the T-shaped slot, and using the pin to secure the posts together.

In another embodiment, when the height of the fence post assembly is not to be increased, the upper member is a fence post cap having a T-shape tongue that is disposed within the T-shaped slot and secured by the pin. The cap thus closes off the slot, preventing material from building up in the slot, and provides a flat top surface to facilitate insertion of the post into the ground. Further, a chain support member having a hook at each end is secured by the cap to the lower post member to enable a chain or the like to be hung between adjacent fence posts.

In each embodiment, the T-shaped slot, T-shaped tongue, and pin provide a fast and easy way to permit adjustments to the height of the fence.

Further, another feature of the invention provides fence strand holding clips integral with the lower post member, and if used, the upper post member for securing fencing members to the post members. Each holder clip includes a first portion rigidly attached to the post member and a second, moveable portion disposed over the first portion and in selective engagement therewith. The first and second portions define a loop therebetween at one end of the holder clip for holding a slender strand member, such as wire or rope. The first and second portions further define an elongated area therebetween for holding a relatively wide strand member, such as tape, therein. The second, moveable portion includes a finger extending therefrom toward the first portion, and the first portion includes a notch that receives the finger when the second portion is engaged with the first portion. The finger separates the loop from the elongated area, to prevent movement of the strand member from its area. In addition, the first portion includes a tapered locking shoulder at one end and the second portion includes a tapered locking tab at an end that corresponds to the one end, so as to form a selectively releasable connection between the first portion and the second portion. A finger actuated tab is connected to the tapered locking tab for releasing the connection between the locking tab and the locking shoulder.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DETAILED DESCRIPTION OF THE DRAWINGS

Figure 1:
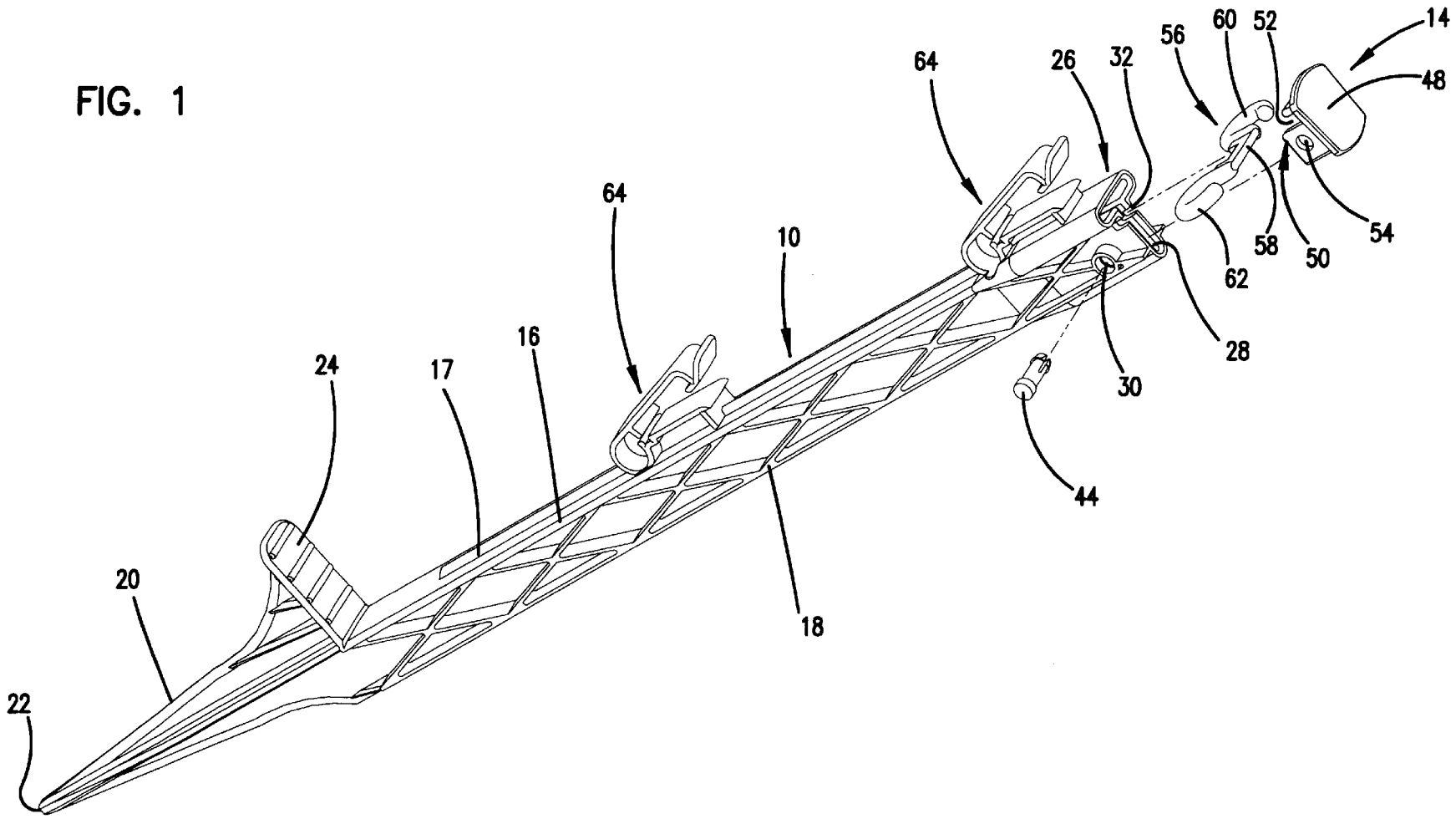
FIG. 1 is a perspective view of the lower post member showing how the post cap and chain support member connect thereto.

Referring now to the figures, there is illustrated a fence post system or assembly including a lower post member 10, and either an upper post member 12 or a post cap 14.

As illustrated in FIGS. 1–5, the lower post member 10 is elongated, and includes a head portion 16 and a stem portion 18 intersecting the head portion perpendicular thereto, thus forming generally a "T" shape. The member 10 is formed from a generally rigid plastic or composite material so that it is non-conducting, and can have any desirable length, such as about 25 inches (63.5 cm). In order to reduce the weight of the member 10 while maintaining adequate strength therefore, the stem portion 18 is a latticed structure between the ends of the post member. It should be noted that in the illustrated embodiment, web portions are provided between the ribs of the latticed structure, that is the lattice structure is not open. This provides added strength to the post member. Preferably, the head portion 16 includes a stiffening rib 17 extending therealong for stiffening the member 10.

The lower end of the member 10 includes a beveled section 20 with a pointed tip 22 and a foot platform 24 extending from the head portion 16 and located at the end of the beveled section, in order to facilitate insertion of the post member into the ground. The user simply uses his foot to apply pressure to the foot platform 24 in order to drive the post member into the ground. The platform 24 is integrally formed with the post member 10 and is suitably stiffened relative thereto to prevent deformation of the platform.

Figure 4:
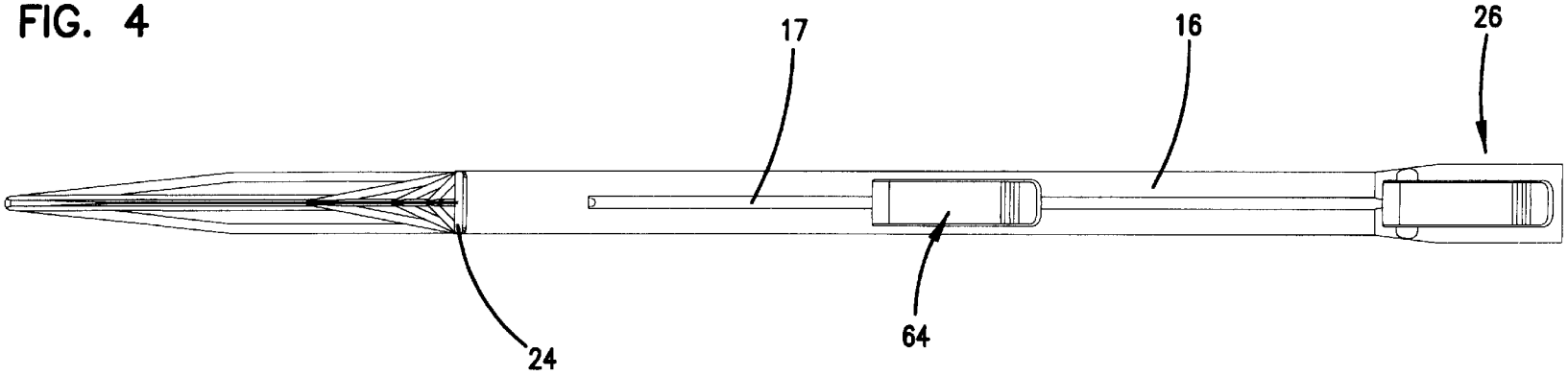
FIG. 4 is a view of one side of the lower post member.
Figure 5:
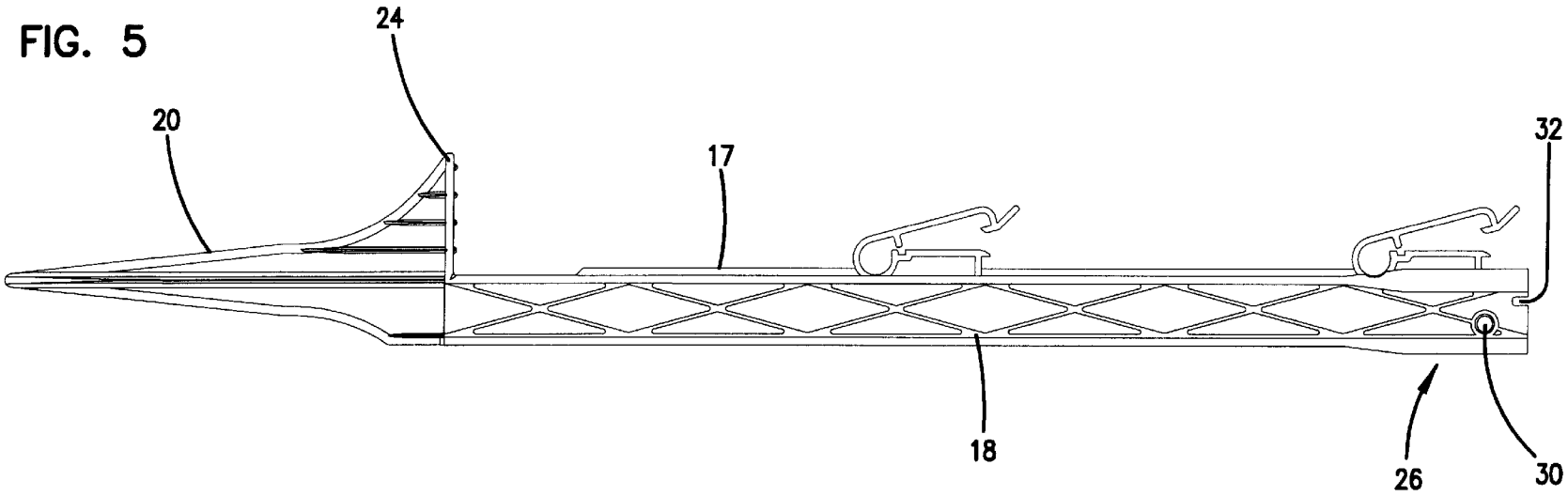
FIG. 5 is a view of another side of the lower post member.

The opposite, upper end 26 of the member 10 is generally thickened or enlarged, as best seen in FIGS. 4–5, with the lattice structure thereof filled in, so as to increase the strength of the upper end. A T-shaped slot 28 is formed through the thickened end 26 extending downward toward the lower end for a pre-determined length, such that the head of the slot is formed in the head portion 16 of the end 26 and the stem of the slot is formed in the stem portion 18 of the end. The slot 28 is thus able to receive the upper post member 12 or the cap 14 therein for either extending the length of the post or closing off the slot. The end 26 also includes an aperture 30 extending through the thickened stem portion 18 and intersecting the stem portion of the slot 28. Also formed in the end 26 is a notch 32 that extends across the thickened stem portion 18 adjacent the head portion 16, the purpose of which will be later described.

Figure 2:
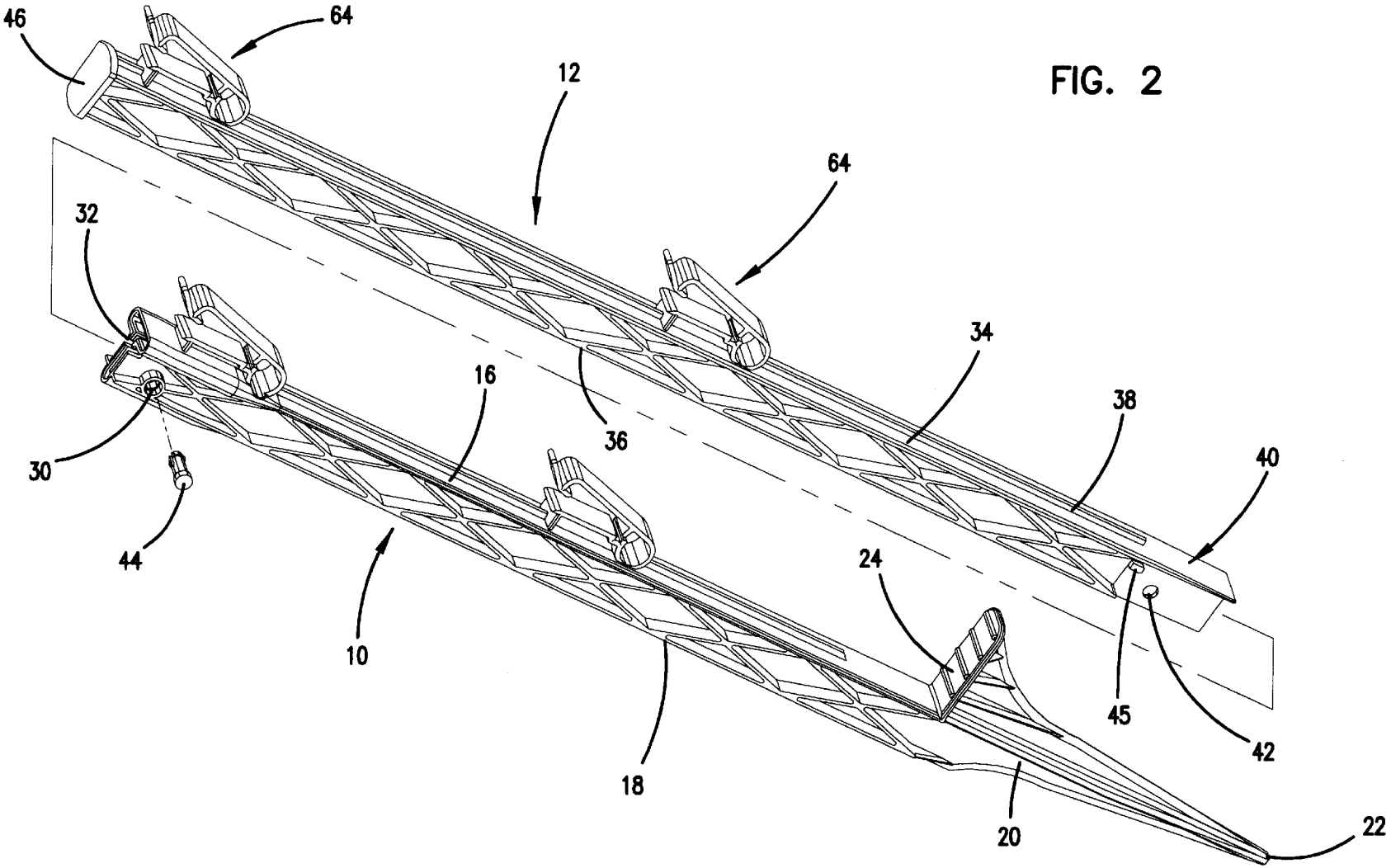
FIG. 2 is a perspective view of the lower post member and upper post member, and how they connect together.
Figure 3:
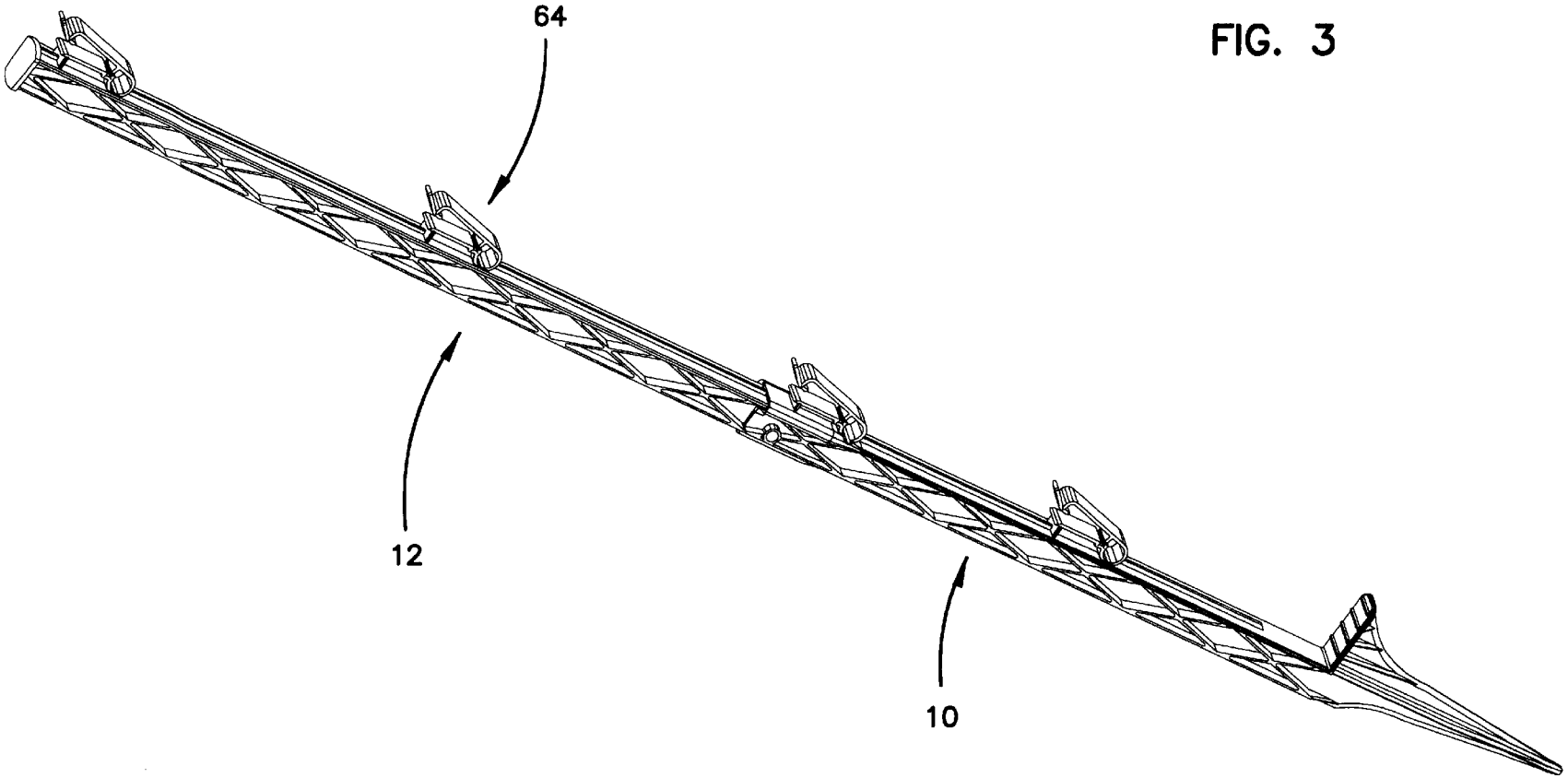
FIG. 3 is a perspective view of the lower post member and upper post member connected together.
Figure 6:
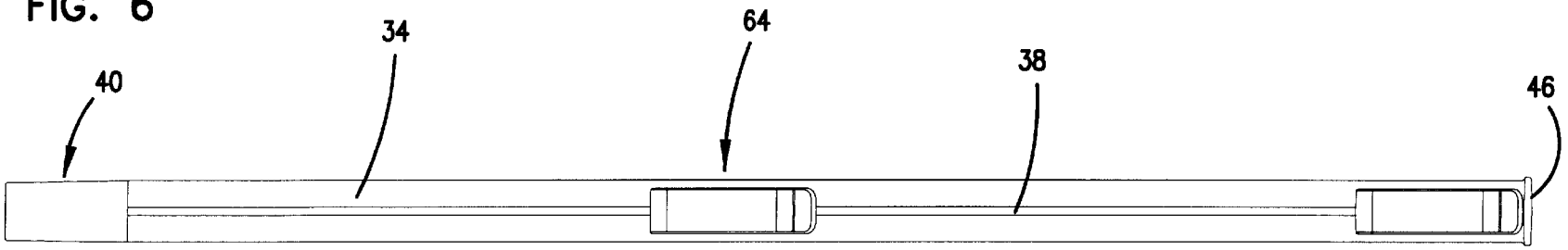
FIG. 6 is a view of one side of the upper post member.
Figure 7:
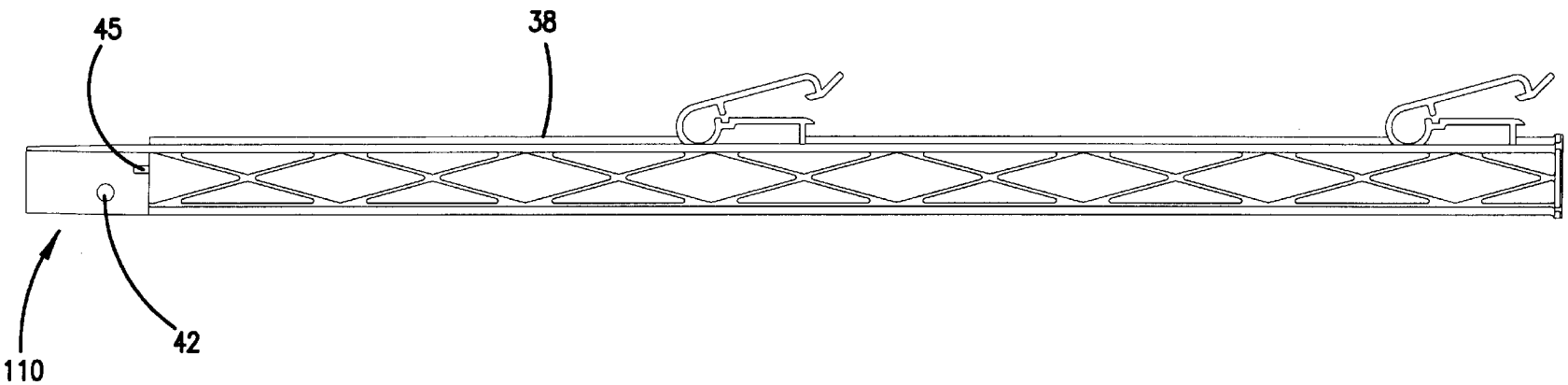
FIG. 7 is a view of another side of the upper post member.

When the height of the fence is to be increased, the upper post member 12 is secured to the lower post member 10. The upper post member 12, as seen in FIGS. 2 and 6–7, is similar to the member 10 in that it is elongated and includes a head portion 34 and a stem portion 36 giving the member 12 an overall "T" shape. The member 12 is formed from a generally rigid plastic or composite material so that it is non-conducting, and has a length such that when attached to the lower member, a fence post of desired size, for instance about 48 inches (121.92 cm), is obtained. The stem portion 36 is also latticed between the ends of the post member, in the same manner as post member 10, in order to reduce weight, while the head portion 34 includes a stiffening rib 38 extending therealong for stiffening the member 12.

The lower end of the member 12 is formed as a non-latticed T-shaped tongue 40 which is sized and shaped for insertion into the T-shaped slot 28. The stem of the tongue 40 includes an aperture 42 therethrough that aligns with the aperture 30 when the tongue is inserted. A plastic locking pin 44 is inserted into the aligned apertures in order to retain the tongue with the slot. The pin 44 is preferably bifurcated and flanged at one end to permit removal of the pin once inserted, and is headed at the opposite end. The tongue 40 also includes a tab 45 extending from each side of the stem portion thereof, which is adpated to fit within the notch 32 on the end 26 of the member 10 to provide additional securement of the upper member 12 to the lower member. The upper end of the member 12 is closed by a post cap 46 forming a flat top surface of the member 12.

If additional fence height is not desired, the upper post cap 14 is secured to the end 26 of the lower member 10. The post cap 14, as best shown in FIG. 1, is also formed from plastic or composite material, and includes a flat top portion 48 and a T-shaped tongue 50 extending from the bottom of the portion 48 that is sized and shaped for insertion into the T-shaped slot 28. The head of the tongue 50 is separated from the stem of the tongue by a notch 52 which aligns with the notch 32. The stem of the tongue 50 further includes an aperture 54 therethrough which aligns with the aperture 30. The pin 44 is then inserted into the apertures 30,54 to secure the tongue 50 within the slot.

A chain support member 56 is disposed within the aligned notches 32,52 in order to enable a chain, or the like, to be hung between adjacent fence posts. The member 56 includes an intermediate portion 58 sized and shaped to snugly fit within the notches, and a pair of hook members 60,62 extending from opposite ends of the portion 58 in a general direction towards an adjacent post. A loop of the chain can thus be hung on one of the hooks 60,62, and a loop hung on a hook on an adjacent post, in order to hang the chain between the posts.

In order to secure fence strand members to the lower post 10, and to the upper post 12 if used, the posts 10,12 include strand holder clips 64 at spaced locations along the length of each post member. As illustrated, there are two clips on each post member, although a smaller or larger number of clips could be used. The holder clips 64 are generally made of the same material as the post members 10,12, such as plastic, in order to be able to support electric strand members without conducting electricity. The holder clips can be integrally formed with the posts during formation of the posts, or secured to the posts after formation thereof. The holder clips are disposed on the head portions 16,34 of the T-shaped posts, on the same side 10 of the posts as the foot platform 24.

Figure 9:
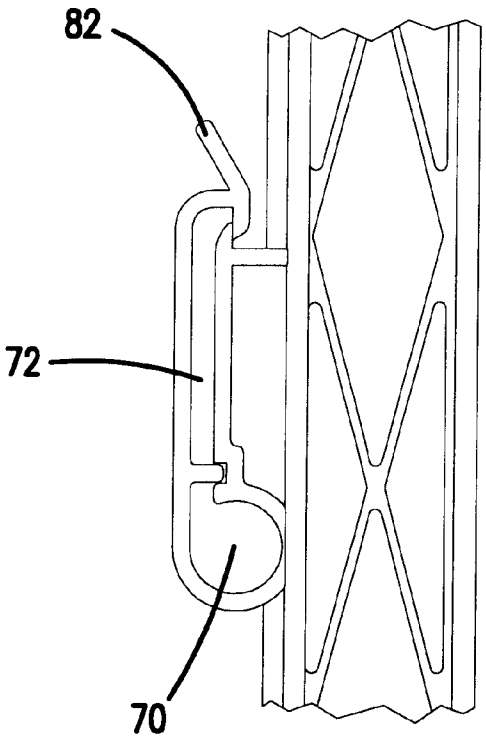
FIG. 9 is a view similar to FIG. 8, but showing the clip in a closed position.
Figure 8:
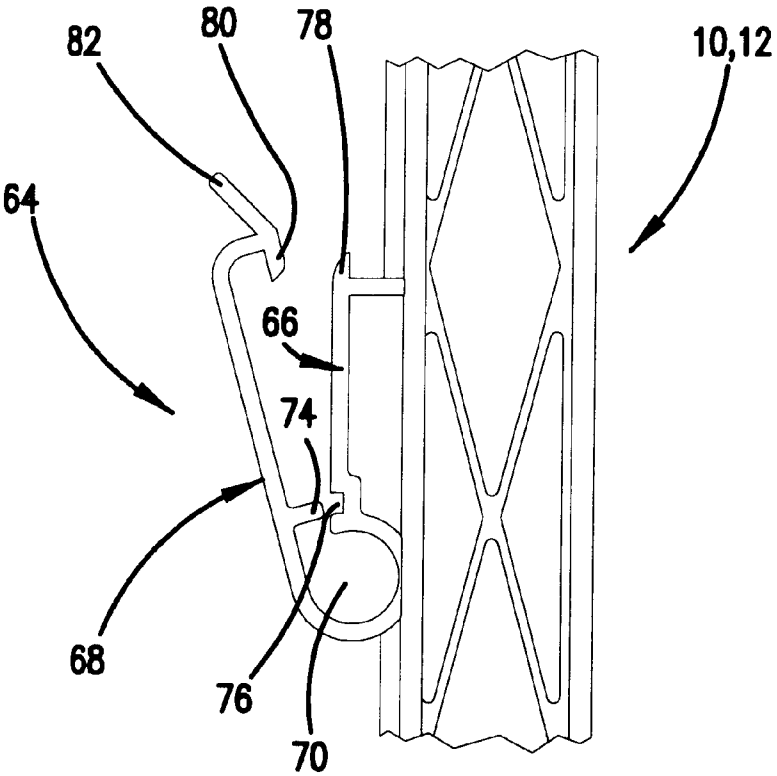
FIG. 8 is a detailed view of a rail holder clip in an open position.

The holder clips 64 are best shown in FIGS. 8 and 9, where it is seen that each holder clip includes a first portion 66 rigidly secured to the head portion of the post members and a second, moveable portion 68 generally doubled back over the first portion so as to form a loop 70 at one end of the holder clip for holding a slender strand member, such as electric wire, barbed wire, or rope. An elongated area 72 is also formed between the overlapping portions 66,68 for holding a broader strand member, such as electric tape, therein. The portion 68 includes a finger 74 extending therefrom toward the portion 66, and the portion 66 includes a notch 76 therein that receives the finger when the second portion is engaged with the first portion, as is seen in FIG. 9. The finger is located between the loop 70 and the elongated area 72 in order to prevent a slender strand member within the loop from moving up into the area 72, and vice-versa.

The two portions 66,68 are selectively releasably engaged with each other to secure the strand members within the clips 64. The portion 66 includes a tapered locking shoulder 78 at one end thereof, while the second portion 68 includes a tapered locking tab 80 at the end thereof corresponding to shoulder 78. The tapered locking tab 80 and the tapered locking shoulder 78 thus form a selectively releasable connection between the first portion and the second portion, with a finger release tab 82 connected to the tapered locking tab 80 for releasing the connection between the locking tab and the locking shoulder. The tab 82 can be pressed using a thumb or finger from the position shown in FIG. 9, so as to release engagement between the tab and shoulder, and permit the first portion to be swung to the position shown in FIG. 8. The tapered portions on the tab and shoulder permit the portion 68 to be moved to the locked position shown in FIG. 9, with the tab and shoulder securely locking the clip once in the locked position.

Although the upper post member 12 has been described as being added to the lower post member 10 in order to increase the fence post height, it should be realized that the upper post member can also be removed from the lower post member so as to decrease the fence post height. In addition, in the situations where the upper post member is not used, it should be realized that the post cap is secured within the slot, and vice versa.

It is to be understood that while certain embodiments of the present invention have been illustrated and described, the invention is not limited to the specific forms or arrangements of parts described and shown.

What is claimed is:

1. A post assembly comprising:

an elongated, T-shaped plastic lower post member having a lower end adapted for insertion into the ground and an upper end having a T-shaped slot formed therein;

a plastic upper member comprising an elongated, T-shaped upper post member with a T-shaped tongue disposed at a lower end of the upper post member, secured to the upper end of said lower post member, the tongue being disposed in the T-shaped slot; and a lock member for securing said tongue within said T-shaped slot.

2. The post assembly according to claim 1, wherein said upper end includes a first aperture extending therethrough that intersects said T-shaped slot, and said tongue includes a second aperture extending therethrough that is aligned with said first aperture.

3. The post assembly according to claim 2, wherein said lock member comprises a locking pin extending through said aligned first and second apertures.

4. The post assembly according to claim 1, wherein said lower end includes a pointed tip and a foot platform for facilitating insertion of the lower end into the ground.

5. The post assembly according to claim 1, wherein said lower and upper T-shaped post members each include a head portion and a stem portion, said stem portion comprising a latticed structure.

6. The post assembly according to claim 5, wherein said latticed structure comprises a plurality of ribs extending between the ends of each post member.

7. The post assembly according to claim 6, wherein said ribs are arranged in a crisscross pattern.

8. The post assembly according to claim 6, further including web portions disposed between the ribs.

9. The post assembly according to claim 1, wherein the upper end and the lower end of the lower post member are part of a unitary assembly.

10. A post assembly comprising:

an elongated, T-shaped plastic lower post member having a lower end adapted for insertion into the ground and an upper end having a T-shaped slot formed therein;

a plastic upper member secured to the upper end of said lower post member, said upper member including a tongue connected thereto disposed within said T-shaped slot; and a lock member for securing said tongue within said T-shaped slot, wherein said upper end includes a first notch formed therein, and said tongue includes a second notch formed therein that is aligned with said first notch, and a chain support member is disposed within said aligned notches in order to secure said chain support member to the post assembly.

11. The post assembly according to claim 10, wherein said chain support member comprises a hook at opposite ends thereof separated by an intermediate portion that is received within the aligned notches.

12. A post assembly comprising:

an elongated, T-shaped plastic lower post member having a lower end adapted for insertion into the ground and an upper end having a T-shaped slot formed therein;

a plastic upper member secured to the upper end of said lower post member, said upper member including a tongue connected thereto disposed within said T-shaped slot; and a lock member for securing said tongue within said T-shaped slot, wherein said lower post member includes at least one plastic fence strand holder clip integral therewith for holding a fence strand member in position upon the lower post member.

13. The post assembly according to claim 12, wherein said upper member comprises a post cap.

14. The post assembly according to claim 13, wherein said post cap includes a flat top portion, and said tongue being T-shaped and extending from a bottom of said flat top portion.

15. The post assembly according to claim 14, wherein said upper end includes a first aperture extending therethrough that intersects said T-shaped slot, and said tongue includes a second aperture extending therethrough that is aligned with said aperture.

16. The post assembly according to claim 15, wherein said lock member comprises a locking pin extending through said aligned first and second apertures.

17. The post assembly according to claim 12, wherein said holder clip comprises a first portion rigidly attached to said lower post member and a second, moveable portion disposed over the first portion and in selective engagement therewith.

18. The post assembly according to claim 17, wherein said first and second portions define a loop therebetween at one end of the holder clip for holding the fence strand member.

19. The post assembly according to claim 18, wherein said first and second portions further define an elongated area therebetween for holding the fence strand member therein.

20. The post assembly according to claim 19, wherein said second, moveable portion includes a finger extending therefrom toward the first portion, and said first portion including a notch therein that receives said finger when the second portion is engaged with said first portion.

21. The post assembly according to claim 20, wherein said finger is located between said loop and said elongated area.

22. The post assembly according to claim 21, wherein said upper member comprises an elongated, T-shaped upper post member aligned with said lower post member, said upper post member including at least one said holder clip thereon.

23. The post assembly according to claim 17, wherein said first portion includes a tapered locking shoulder at one end thereof and said second portion includes a tapered locking tab at an end thereof corresponding to said one end, said tapered locking tab and said tapered locking shoulder forming a selectively releasable connection between said first portion and said second portion.

24. The post assembly according to claim 23, further including a finger actuated tab connected to the tapered locking tab for releasing the connection between the locking tab and the locking shoulder.

25. An insulated, plastic fence post system comprising:

an elongated, T-shaped, plastic lower member having a lower end adapted for insertion into the ground and an upper end having a T-shaped slot formed therein;

a plastic upper member comprising an elongated T-shaped post adapted for securement to the upper end of the lower post member, said upper member including a T-shaped tongue disposed at a lower end of the upper member and adapted for disposition within said T-shaped slot; and a locking pin for locking said T-shaped tongue within said T-shaped slot when the tongue is disposed therein.

26. The insulated, plastic fence post system according to claim 25, wherein the upper end and the lower end of the lower post member are part of a unitary assembly.

27. An insulated, plastic fence post system comprising:

an elongated, T-shaped, plastic lower post member having a lower end adapted for insertion into the ground and an upper end having a T-shaped slot formed therein;

a plastic upper member adapted for securement to the upper end of the lower post member, said upper member including a T-shaped tongue connected thereto and adapted for disposition within said T-shaped slot; and a locking pin for locking said T-shaped tongue within said T-shaped slot when the tongue is disposed therein, wherein said lower post member includes at least one plastic fence strand holder clip integral therewith for holding a fence strand member in position upon the lower member.

28. The insulated, plastic fence post system according to claim 27, wherein said upper member comprises a post cap.

29. The insulated, plastic fence post system according to claim 28, wherein said post cap includes a flat top portion, and said T-shaped tongue extends from a bottom of said flat top portion.

30. The insulated, plastic fence post system according to claim 27, wherein said upper member comprises an elongated, T-shaped upper post member, said upper post member including at least one said holder clip thereon.

* * * * *